US005896716A

United States Patent [19]

Jalla

[11] Patent Number: 5,896,716

[45] **Date of Patent: *Apr. 27,1999**

[54] JOIST SPLICE SHOE

[76] Inventor: Maharaj K. Jalla, 7817 Calpurnia Ct., Mclean, Va. 22102

[ * ] Notice: This patent issued on a continued prosecution application filed under 37 CFR 1.53(d), and is subject to the twenty year patent term provisions of 35 U.S.C. 154(a)(2).

[21] Appl. No.: 08/679,375

[22] Filed: Jul. 8, 1996

[51] Int. Cl.[6] ..... E04C 5/01; E04G 23/02

[52] U.S. Cl. ..... 52/514; 52/712; 52/DIG. 6; 411/466

[58] Field of Search ..... 52/DIG. 6, 726.2, 52/514, 712; 403/283; 411/461, 462, 463, 464, 465, 466, 467, 468, 471, 472

[56] References Cited

U.S. PATENT DOCUMENTS

| | | | |
|---|---|---|---|
| 1,669,541 | 5/1928 | Spreen | 411/466 |
| 2,877,520 | 3/1959 | Jureit | 403/283 |
| 2,973,175 | 2/1961 | Appleton | 411/466 |
| 3,225,643 | 12/1965 | Couch | 52/712 |
| 3,305,252 | 2/1967 | Jureit | 52/712 |
| 4,272,938 | 6/1981 | Seipos | 411/467 |
| 4,297,048 | 10/1981 | Jureit et al. | 411/466 |
| 4,366,659 | 1/1983 | Jensen | 52/DIG. 6 |
| 4,488,389 | 12/1984 | Farmont | 403/283 |
| 4,659,604 | 4/1987 | Lambuth | 52/DIG. 6 |
| 4,738,071 | 4/1988 | Ezaro | 52/DIG. 6 |

*Primary Examiner*—Michael Safavi

[57] ABSTRACT

A joist splice shoe for repairing damaged lumber joists of residential buildings. The joist splice shoe is a plate made of steel, which is bent to a U-shape when in use, and has unitary prongs provided in the sidewalls except in the middle portions. Each unitary prong has an elongated, curved portion tapering to a penetrating end. Only a single joist splice shoe needs to be installed to repair a damaged lumber joist with ease and a minimum of labor. When placed in position, the sidewall middle portions and the bottom wall envelop the zone of distress of the lumber joist from the bottom, and the prongs are embedded in adjacent undamaged portions of the joist. The tensile and shear stresses acting at the distressed zone are thereby effectively resisted and transmitted to the adjacent undamaged portions.

1 Claim, 4 Drawing Sheets

JOIST SPLICE SHOE

INTRODUCTION

The present invention relates to a new piece of hardware for repairing damaged lumber joists of residential buildings.

In current practice, a distressed lumber joist is repaired by scabbing plywood or lumber with nails on both the vertical sides of the joist. With such methods, the task of carrying out repairs tends to be a strenuous one.

The primary object of the present invention is to provide an alternative hardware for repairing a damaged lumber joist that is sound from an engineering point of view, and easy to use. The invented hardware is a joist splice shoe, which is a U-shaped plate made of steel or any other suitable metal, with unitary prongs used as fastening means. When a single joist splice shoe is attached to a damaged lumber joist across the line or zone of distress, it effectively resists tensile and shear stresses transmitted from the lumber joist.

BRIEF DESCRIPTION OF THE FIGURES

The present invention will be more readily understood by reference to the following detailed description when read in conjunction with the attached drawings.

DETAILED DESCRIPTION

Repair methods used at the present time mostly depend upon the extent of damage in a lumber joist. In these methods, restoration of a damaged or cracked lumber joist is either by replacing the joist or by scabbing the joist using lumber or plywood and nails. Invariably, this creates the task of carrying out repairs of a distressed lumber joist to be a strenuous one because the repair material used is heavy and unwieldy. The structural adequacy of such a repair is also doubtful.

The basic contribution of the present invention involves reduction of the overall weight of repair material by using a joist splice shoe so as to enable convenient repair of a distressed lumber joist. The invention also provides a novel alternative to conventional fasteners by using unitary prongs that add to the ease of affixing a joist splice shoe to a distressed lumber joist. As a single joist splice shoe is used at the zone of distress, repair can be carried out with ease and a minimum of labor.

Figure 1:
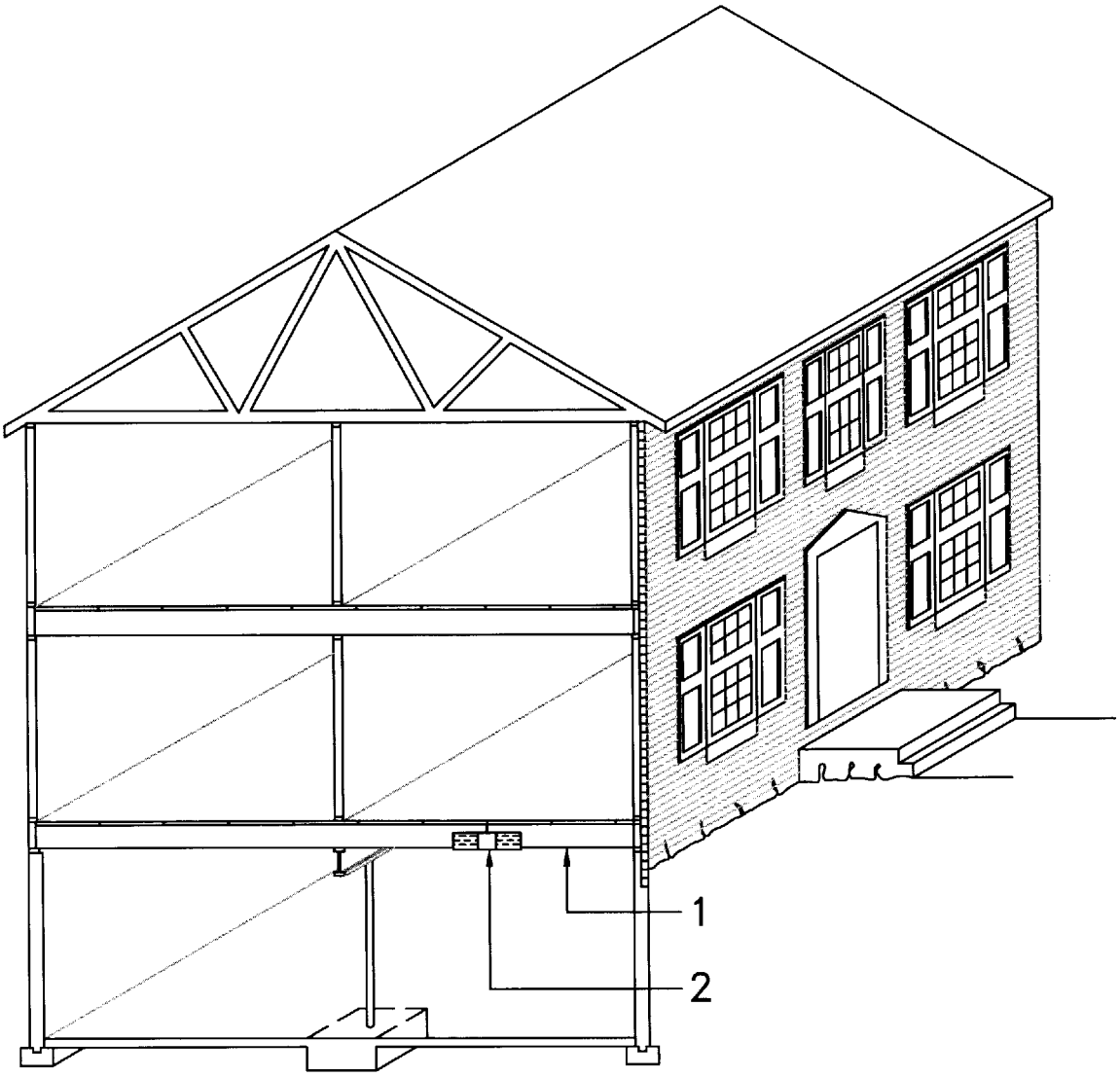
FIG. 1 is an isometric view of a typical residential house showing a lumber joist in distress, to which a joist splice shoe of the present invention is attached.

In the FIG. 1 layout of a typical residential house, a distressed lumber joist is indicated by 1, and a metallic U-shaped plate of the present invention known as joist splice shoe is indicated by 2.

Figure 2:
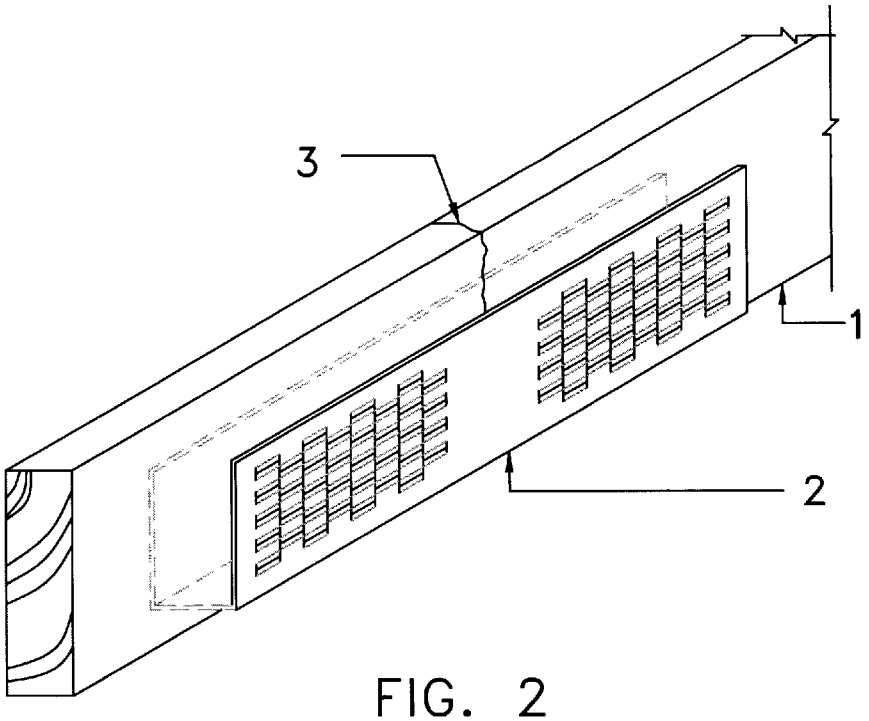
FIG. 2 is an isometric view of the distressed lumber joist of FIG. 1 along with the joist splice shoe.

The lumber joists of FIG. 1 support vertical loads of overlying floors. In each joist, the maximum tensile stress is developed along the lowermost fiber, and is the maximum midway of the length of the joist. Once a crack 3 develops in the lumber joist 1 as shown in FIG. 2, it is the lower portion of the joist which is the most vulnerable. Hence, repair of the lower portion of a distressed lumber joist assumes importance.

The novel feature of this invention involves laying out a system to efficiently transfer the developed tensile and shear stresses in a lumber joist at the zone of distress to a plate made of steel or any other suitable metal having higher strength than lumber.

Figure 3:
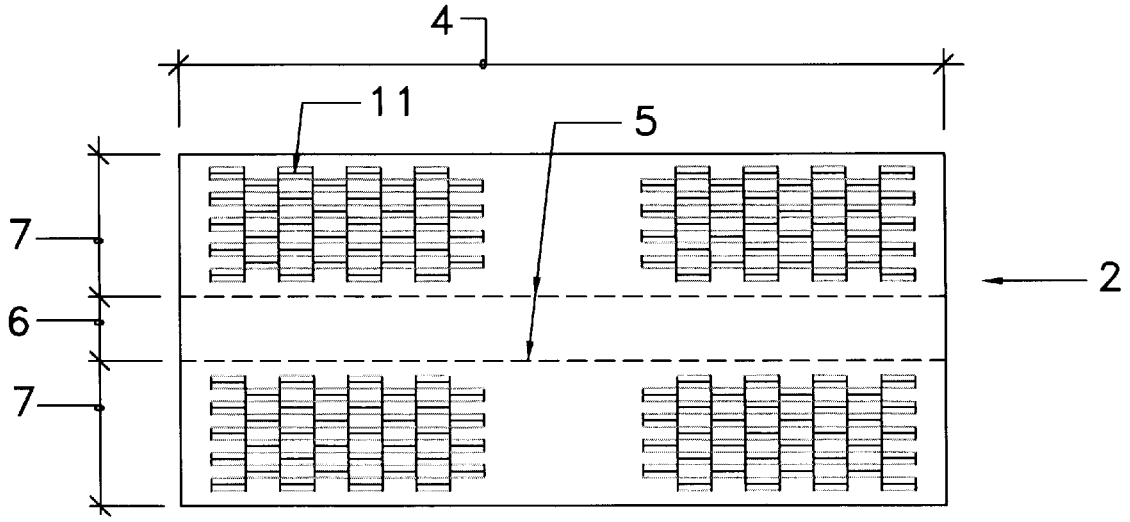
FIG. 3 depicts a plan view of the joist splice shoe before bending to its final U-shape.

FIG. 3 depicts a joist splice shoe before bending to its final U-shape, having length 4 which is dependent on the magnitude of the load supported by the distressed lumber joist or the maximum tensile stress developed in the joist. Numeral 5 indicates lines along which the joist splice shoe is bent, and the numerals 6 & 7 indicate dimensions that depend on the size of the distressed lumber joist to be repaired.

Figure 4:
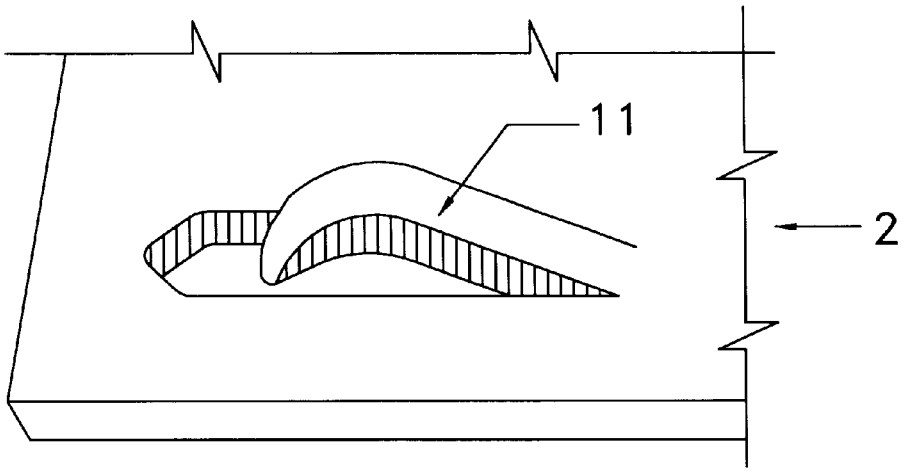
FIG. 4 is an isometric view of a unitary prong of the joist splice shoe.

The U-shaped joist splice shoe has unitary prongs formed in the sidewalls as means for attachment to a distressed lumber joist. The unitary prongs are indicated by 11, and the isometric view of a unitary prong is shown in FIG. 4. These unitary prongs eliminate the requirement for non-unitary fastening means such as nails. Each unitary prong has an elongated, curved portion tapering to a penetrating end. The penetrating ends are directed towards the surface of the joist to which the joist splice shoe is to be secured. The extremities of the penetrating ends do not extend inside the space between the sidewalls.

In its final U-shape, the axes of the unitary prongs in each sidewall are oriented substantially parallel to the plane of the bottom wall. For each sidewall, the center line that is perpendicular to the plane of the bottom wall defines a line of symmetry about which the penetrating ends of corresponding prongs are directed. Because of this arrangement, the grip of a joist splice shoe over a distressed lumber joist increases upon application of load.

Figure 5:
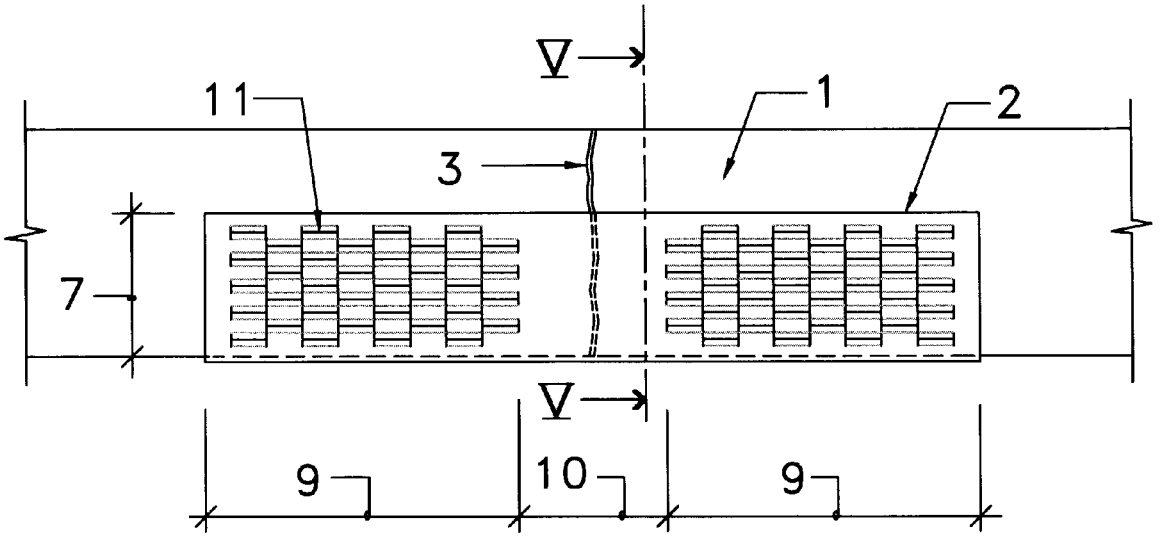
FIG. 5 is a side elevation view of FIG. 2 for illustrating details of the attachment position of the joist splice shoe at the zone of distress.
Figure 6:
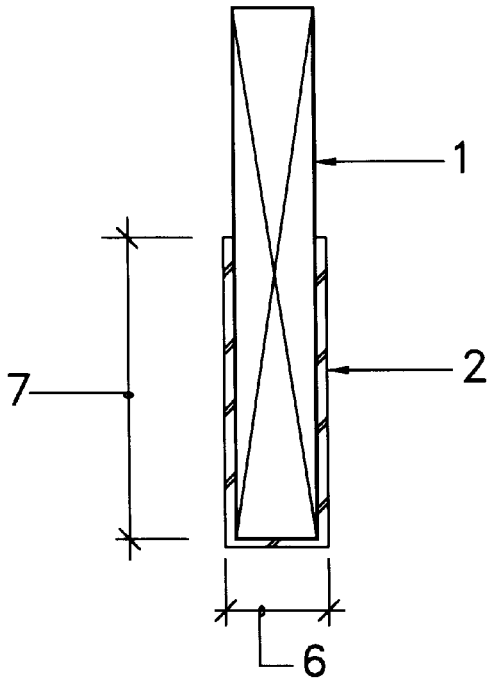
FIG. 6 is a cross-sectional view taken along lines V—V of FIG. 5.

Orientation of the joist splice shoe 2 with respect to the line of distress 3 of the lumber joist 1 is depicted in FIG. 5. For a proper repair of the distressed lumber joist, effective transfer of stresses to the joist splice shoe is necessary. This is ensured by keeping the joist splice shoe free of unitary prongs or holes along portion 10 of FIG. 5 and along portion 6 of FIG. 6, so that these portions envelop the distressed zone of the lumber joist from three sides, and resist tensile and shear stresses transmitted from the lumber joist.

As the first step of attachment of the joist splice shoe, the bottom portion 6 is brought into contact with the bottom surface of the distressed lumber joist ensuring that the middle of portion 10 lies just below the line of distress, and the unitary prongs in portions 9 are flattened with a mallet to ensure complete clasping on the lumber joist at the undamaged portions adjacent to the distressed zone.

Figure 7:
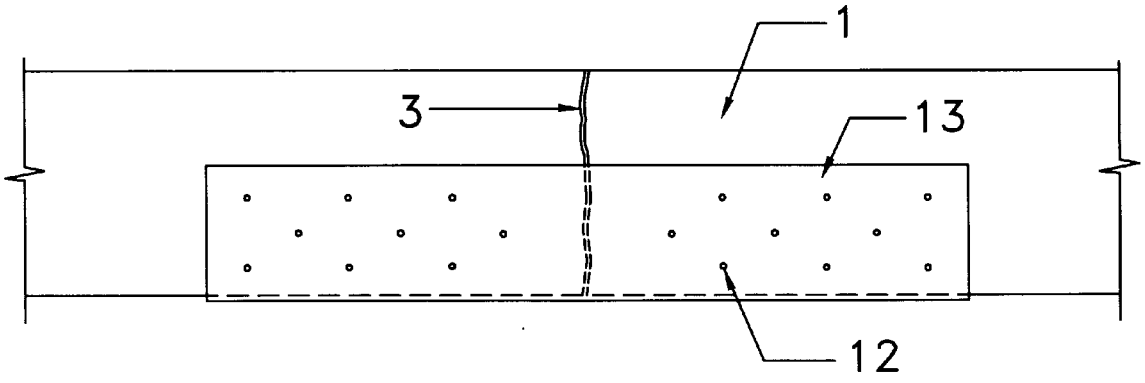
FIG. 7 is a side elevation view illustrating another embodiment of the joist splice shoe attached to a damaged lumber joist using nails.

An alternative embodiment of the joist splice shoe has no unitary prongs and is indicated by 13 in FIG. 7. This alternative embodiment is secured to a damaged joist 1 using nails 12 through its sidewalls at locations corresponding to the locations of unitary prongs 11 of the preferred embodiment indicated by 2.

While specific configurations have been set forth for the purpose of describing the novel features of the invention, it should be recognized that such specifics can be varied by relying on the technology as taught, without departing from the principles of the invention. Therefore, in determining the scope of the present invention, reference shall be made to the appended claims.

What is claimed is:

1. A joist splice shoe for attachment to the distressed zone of a damaged lumber joist of any residential building so as to repair said damaged lumber joist, said joist splice shoe comprising:

a bottom wall, two substantially parallel sidewalls connected to said bottom wall, with said bottom wall and said sidewalls forming a U-shaped cross-section adapted for receiving sides of said damaged lumber joist, and a plurality of unitary prongs struck in row pattern from each said sidewall over substantially its entire area except for its middle portion, with each said unitary prong having an elongated, curved portion tapering to a penetrating end that is directed towards corresponding said sidewall;

said curved portions and said penetrating ends of said prongs not extending inside the U-shaped cross-section formed by said bottom wall and said sidewalls, and said bottom wall being free of holes;

axes of said unitary prongs being substantially parallel to the plane of said bottom wall, with the center line of each said sidewall that is substantially perpendicular to the plane of said bottom wall defining a line of symmetry about which said penetrating ends of corresponding said prongs are directed; and in the attachment position of a single said joist splice shoe, said bottom wall as well as said middle portions of said sidewalls are placed flush against and around said distressed zone of said lumber joist from the bottom and sides, and said penetrating ends are embedded fully in the sides of said damaged lumber joist away from said distressed zone; thereby ensuring that said middle portions and said bottom wall effectively resist tensile and shear stresses acting at said distressed zone.

* * * * *